US012285644B1

(12) United States Patent
Wang et al.

(10) Patent No.: US 12,285,644 B1
(45) Date of Patent: Apr. 29, 2025

(54) CONNECTOR

(71) Applicant: Shenzhen Shenlaiyibi Technology Co., Ltd., Shenzhen (CN)

(72) Inventors: Longfei Wang, Dingzhou (CN); Zhihao Qiu, Jiangshan (CN)

(73) Assignee: Shenzhen Shenlaiyibi Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/672,553

(22) Filed: May 23, 2024

(51) Int. Cl.
*A63B 21/055* (2006.01)
*A63B 21/00* (2006.01)
*A63B 21/072* (2006.01)

(52) U.S. Cl.
CPC ..... *A63B 21/0557* (2013.01); *A63B 21/0724* (2013.01); *A63B 21/4015* (2015.10); *A63B 21/4035* (2015.10)

(58) Field of Classification Search
None
See application file for complete search history.

(56) References Cited

U.S. PATENT DOCUMENTS 5,496,243 A * 3/1996 Allen ..... A63B 21/0601 482/106
7,081,072 B2 * 7/2006 Allen ..... A63B 21/072 285/133.11
9,149,680 B2 * 10/2015 Thompson ..... A63B 21/072
9,731,159 B2 * 8/2017 Reynolds ..... A63B 21/4035
10,086,225 B2 * 10/2018 Sheppard ..... A63B 21/0728
10,610,721 B2 * 4/2020 McCall ..... A63B 21/0722
11,179,588 B2 * 11/2021 McCall ..... A63B 1/00
11,555,577 B2 * 1/2023 Park ..... F16B 2/185
11,752,385 B2 9/2023 Abbott et al.
11,911,648 B2 2/2024 Dickstein
2011/0173778 A1 * 7/2011 Wales ..... B25G 3/20 16/426
2011/0177922 A1 * 7/2011 Selinger ..... A63B 21/0724 482/107
2012/0252641 A1 * 10/2012 Odneal ..... A63B 21/072 482/108
2014/0018214 A1 * 1/2014 Jordan ..... A63B 21/072 482/107
2014/0135186 A1 * 5/2014 Reynolds ..... A63B 21/072 482/108
2015/0105224 A1 * 4/2015 Odneal ..... B22D 17/00 164/47
2017/0266479 A1 * 9/2017 McCall ..... A63B 15/00
(Continued)

*Primary Examiner* — Joshua Lee

(57) ABSTRACT

Disclosed is a connector, which comprises a first main body with a rotation end and a closed end and a second main body rotatably connected to the first main body, wherein a first through groove is provided at an inner side of the first main body, a second through groove is provided at the second main body, the first through groove and the second through groove enclose to form a fixed cavity, the first main body is further provided with a connection pipe communicated with the first through groove, and the connector further comprises a locking device used to open or close the fixed cavity. When the fitness equipment is disassembled, only the first main body and the second main body need to be unlocked by the locking device without disassembling the sporting equipment connected to the connection pipe, which makes mounting and disassembly of the fitness equipment more convenient.

10 Claims, 11 Drawing Sheets

(56) References Cited

U.S. PATENT DOCUMENTS

| | | | | |
|---|---|---|---|---|
| 2019/0366143 | A1* | 12/2019 | McCall | A63B 21/4035 |
| 2022/0062693 | A1 | 3/2022 | Martinez | |
| 2022/0314060 | A1* | 10/2022 | Fogle | A63B 21/0728 |
| 2022/0355153 | A1* | 11/2022 | Abbott | A63B 21/0724 |
| 2023/0330471 | A1 | 10/2023 | Theofilos | |
| 2023/0405388 | A1 | 12/2023 | Abbott et al. | |

* cited by examiner

CONNECTOR

TECHNICAL FIELD

The present utility model relates to the technical field of fitness equipment, and in particular, to a connector.

BACKGROUND

Sporting equipment is simple equipment used to strengthen muscle strength training and is named due to the characteristic of no sound generated during training. The sporting equipment is used for muscle strength training and muscle compound action training. Patients with low muscle strength due to exercise paralysis, pain, long-term inactivity and the like can use the weight of the sporting equipment to actively exercise resistance and train muscle strength by holding the sporting equipment. To cater to a large number of fitness enthusiasts, connectors emerged, which can transform the sporting equipment into various fitness equipment. In the prior art, a connection pipe is formed at a top of a left shell and a right shell of the connector after the left shell and the right shell are attached, and then the left shell and the right shell are fixed by connecting nuts to the connection pipe. When the sporting equipment is mounted and disassembled, the left shell and the right shell need to be opened, which is inconvenient to use. Therefore, it is necessary to provide a connector to solve the above technical problem.

SUMMARY

The present utility model provides a connector, which solves the following problem: in the prior art, a connection pipe is formed at a top of a left shell and a right shell of the connector after the left shell and the right shell are attached, then the left shell and the right shell are fixed by connecting nuts to the connection pipe, and when the sporting equipment is mounted and disassembled, the left shell and the right shell need to be opened, which is inconvenient to use.

To solve the above technical problem, a technical solution of the present utility model is as follows. The present utility model provides a connector, which comprises a first main body with a rotation end and a closed end, and a second main body that is rotatably connected to the rotation end of the first main body and can be closed with the closed end of the first main body, wherein a first through groove is provided at an inner side of the first main body, a second through groove is provided at a position of the second main body opposite to the first through groove, the first through groove and the second through groove enclose to form a fixed cavity used to fix fitness equipment, the first main body is further provided with a connection pipe used to connect the fitness equipment, the connection pipe is communicated with the first through groove, a vertical plane where the connection pipe is positioned is not coplanar with a vertical plane where the rotation end is positioned and a vertical plane where the closed end is positioned, and the connector further comprises a locking device used to open or close the fixed cavity.

According to the present utility model, the closed end of the first main body is further provided with a fixed block protruding towards the second main body, a fixed groove is provided at a position of the second main body opposite to the fixed block, and the locking device is connected to the fixed block.

According to the present utility model, the fixed block is provided with a strip-shaped through groove extending along a length direction of the fixed block, the locking device comprises a mounting frame connected in the strip-shaped through groove and a first toggle assembly and a second toggle assembly which are arranged in the mounting frame, the first toggle assembly and the second toggle assembly are symmetrically arranged and can move oppositely along the mounting frame, and when the first toggle assembly and the second toggle assembly are moved to pass through the first main body and partially pass through the second main body, the first main body and the second main body are locked.

According to the present utility model, the first toggle assembly comprises a first toggle block and a first positioning rod connected to a side of the first toggle block, and the second toggle assembly comprises a second toggle block and a second positioning rod connected to a side of the second toggle block.

According to the present utility model, a limiting block is further provided in the mounting frame, and the limiting block is positioned between the first toggle assembly and the second toggle assembly.

According to the present utility model, the first main body is further provided with a nut that is connected to the connection pipe in a threaded manner and is used to fix sporting equipment and a bolt that is connected to the nut and is used to clamp the sporting equipment, and the nut is in a hollow arrangement.

According to the present utility model, a fastener used to fasten the fitness equipment is further provided in the first main body, and the fastener is compressed when the nut rotates.

According to the present utility model, the fastener comprises a reset post positioned in the connection pipe, a fastening piece positioned in the first through groove and an end of which extends into the reset post, and a reset spring positioned between the reset post and the fastening piece and used to reset the reset post.

According to the present utility model, the sporting equipment is a kettlebell handle, a lower part of the kettlebell handle is provided with a connection post extending into the connection pipe, and a peripheral side of the connection post is provided with an annular groove clamped with the bolt.

According to the present utility model, the sporting equipment is a barbell rod, the connectors are symmetrically arranged, connection posts extending into the connection pipe are arranged at two ends of the barbell rod, and peripheral sides of the connection posts are provided with annular grooves clamped with the bolts.

According to the present utility model, the sporting equipment is a shoe cover, a bottom of the shoe cover is provided with a connection post extending into the connection pipe, and a peripheral side of the connection post is provided with an annular groove clamped with the bolt.

According to the present utility model, the sporting equipment is a band, the connectors are symmetrically arranged, connection posts extending into the connectors are arranged at two ends of the band, and peripheral sides of the connection posts are provided with annular grooves clamped with the bolts.

Compared with the prior art, the present utility model has the beneficial effects that: the connector of the present utility model clamps the fitness equipment and places the fitness equipment in the first through groove, the second main body rotates with the rotation end of the first main body as a rotation center and is closed with the closed end of the first main body, the closed first main body and the closed second main body are locked by the locking device, and when the fitness equipment is disassembled, only the first main body and the second main body need to be unlocked by the locking device without disassembling the sporting equipment connected to the connection pipe, which makes mounting and disassembly of the fitness equipment more convenient.

BRIEF DESCRIPTION OF DRAWINGS

To more clearly illustrate the technical solution in the embodiments of the present utility model or in the prior art, the drawings required to be used in the description of the embodiments or the prior art are briefly introduced below. The drawings in the following description are only the corresponding drawings of some embodiments of the present utility model.

DETAILED DESCRIPTION OF EMBODIMENTS

To make objectives, technical solutions, and advantages of embodiments of the present disclosure clearer, the following clearly and completely describes technical solutions in embodiments of the present disclosure with reference to accompanying drawings in embodiments of the present disclosure. It is clear that the described embodiments are merely some but not all of embodiments of the present disclosure. Based on the described embodiments of the present disclosure, all other embodiments obtained by those of ordinary skill in the art without creative efforts fall within the protection scope of the present disclosure.

Unless otherwise defined, the technical terms or scientific terms used herein shall have the ordinary meaning understood by those of ordinary skill in the art to which the present disclosure belongs.

The terms "first", "second", and the like used in the specification and claims of this patent application do not indicate any order, quantity, or importance, but rather are used to distinguish different components. The terms "comprises", "includes", or other similar terms mean that the elements or items listed before "comprises" or "includes" cover the elements or items and equivalents thereof listed after "comprises" or "includes", and other elements or items are not excluded. The terms "connection", "connect to", or other similar terms are not limited to physical or mechanical connections, but may include electrical connections, whether direct or indirect. The terms "upper", "lower", "left", "right", and the like are only used to indicate the relative positional relationship. When the absolute position of the described object changes, the relative positional relationship may also change accordingly.

The technical solutions in the embodiments of the present utility model will be clearly and completely described below with reference to the drawings in the embodiments of the present utility model. It is apparent that the described embodiments are only some, but not all, embodiments of the present utility model. Based on the embodiments of the present utility model, all other embodiments obtained by those skilled in the art without creative efforts fall within the protection scope of the present utility model.

The present utility model provides a preferred embodiment of a connector that can solve the above technical problem.

Figure 1:
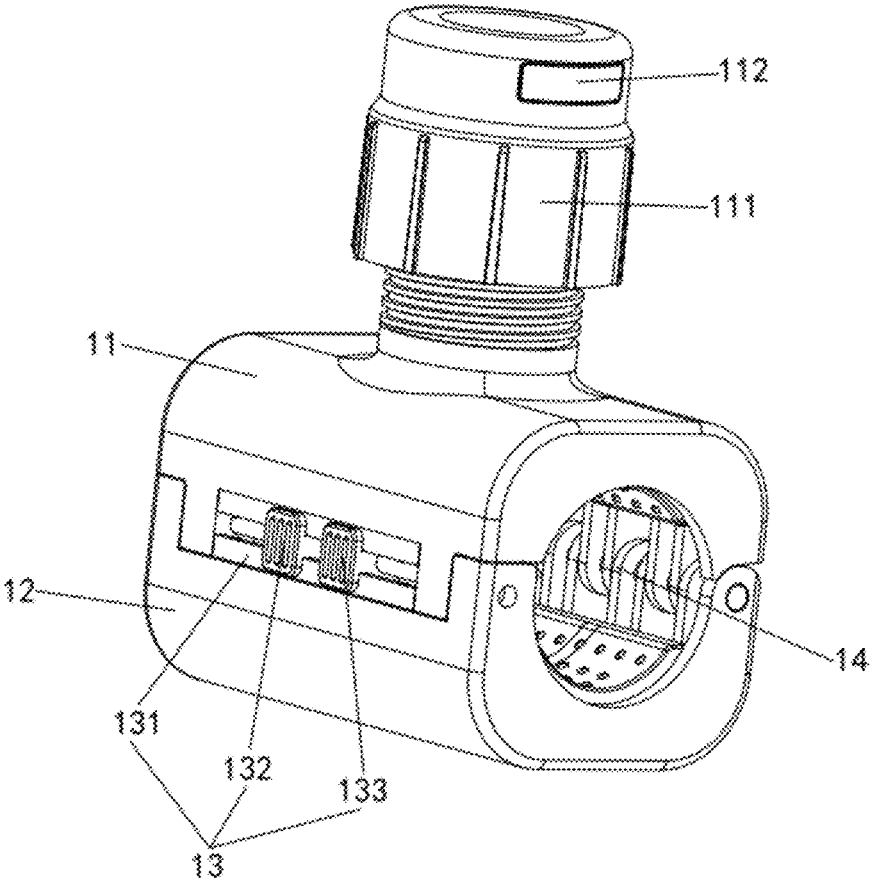
FIG. 1 is a perspective view 1 of a connector according to the present utility model.
Figure 2:
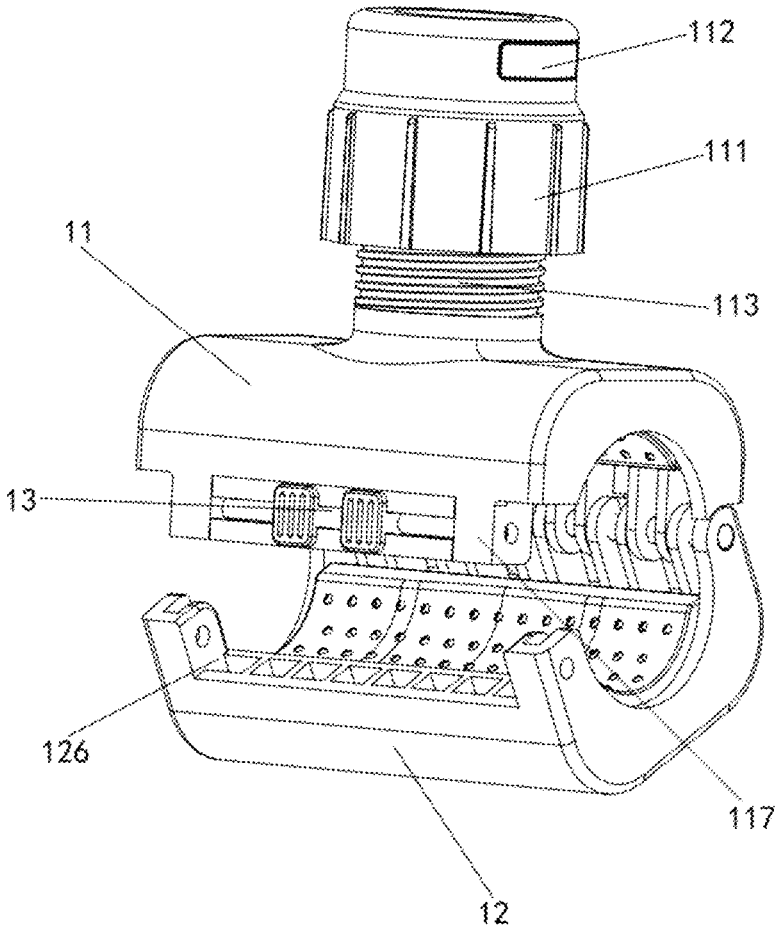
FIG. 2 is a perspective view 2 of a connector according to the present utility model.

Referring to FIGS. 1 and 2, FIG. 1 is a perspective view 1 of a connector according to the present utility model, and FIG. 2 is a perspective view 2 of a connector according to the present utility model.

In the drawings, elements having similar structures are denoted by the same reference numerals.

In the present utility model, the terms "first", "second", and the like are merely intended for description, and shall not be interpreted as indicating or implying relative importance, nor as limiting the sequence.

The present utility model provides a connector, which comprises a first main body 11 with a rotation end and a closed end, and a second main body 12 that is rotatably connected to the rotation end of the first main body 11 and can be closed with the closed end of the first main body 11, wherein a first through groove is provided at an inner side of the first main body 11, a second through groove is provided at a position of the second main body 12 opposite to the first through groove, the first through groove and the second through groove enclose to form a fixed cavity 14 used to fix fitness equipment, the first main body 11 is further provided with a connection pipe 113 used to connect the fitness equipment, the connection pipe 113 is communicated with the first through groove, a vertical plane where the connection pipe 113 is positioned is not coplanar with a vertical plane where the rotation end is positioned and a vertical plane where the closed end is positioned, the connector further comprises a locking device 13 used to open or close the fixed cavity 14, the first main body 11 and the second main body 12 are used to clamp the fitness equipment, the fitness equipment is placed in the first through groove, the second main body 12 rotates towards the first main body 11, the second main body 12 rotates with the rotation end of the first main body 11 as a rotation center, when the second main body 12 rotates to attach to the closed end of the first main body 11, the fitness equipment is positioned in the fixed cavity 14 formed by the first through groove and the second through groove, and the fixed cavity 14 is used to clamp the fitness equipment. Further, the first main body 11 and the second main body 12 are fixed by the locking device 13, which prevents the first main body 11 and the second main body 12 from being separated, the fitness equipment is fixed in the fixed cavity 14, which prevents the fitness equipment from being separated from the first main body 11 and the second main body 12, when the fitness is required, the sporting equipment is simply connected in the connection pipe 113, when the fitness equipment needs to be disassembled, only the locking device 13 needs to loosen the first main body 11 and the second main body 12, and the fitness equipment can be replaced or disassembled without disassembling the sporting equipment connected in the connection pipe 113, which makes mounting and disassembly simpler and more convenient.

The closed end of the first main body 11 is further provided with a fixed block 117 protruding towards the second main body 12, a fixed groove 126 is provided at a position of the second main body 12 opposite to the fixed block 117, the locking device 13 is connected to the fixed block 117, the fixed block 117 of the first main body 11 is used to extend into the fixed groove 126 of the second main body 12, the fixed groove 126 is used to limit the fixed block 117, and the first main body 11 and the second main body 12 are closed to prevent the first main body 11 and the second main body 12 from shifting. Further, since the locking device 13 is positioned on the fixed block 117, after the first main body 11 and the second main body 12 are closed, the locking device 13 is used to fix the closed first main body 11 and the closed second main body 12, and thus the fitness equipment is fixed in the first main body 11 and the second main body 12.

Figure 3:
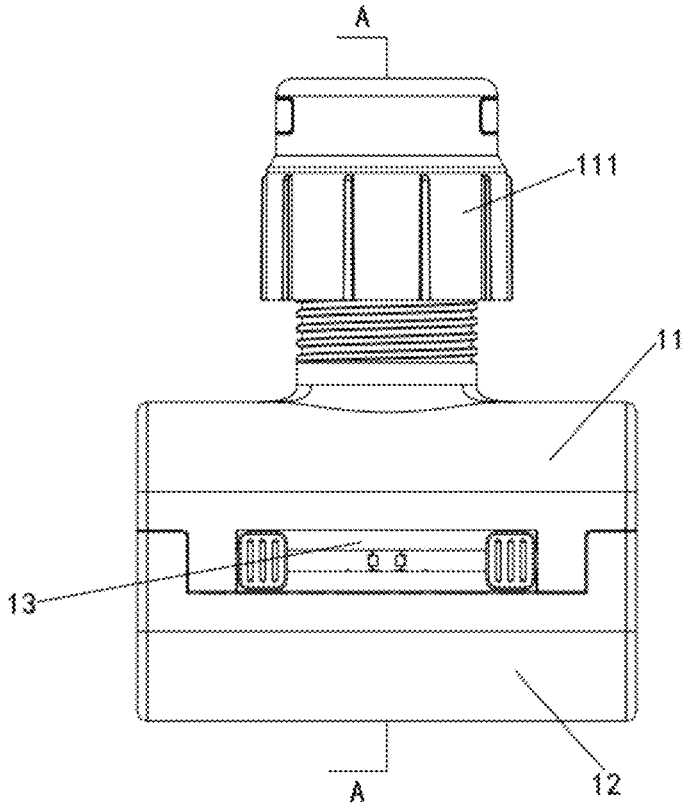
FIG. 3 is a main view of a connector according to the present utility model.
Figure 4:
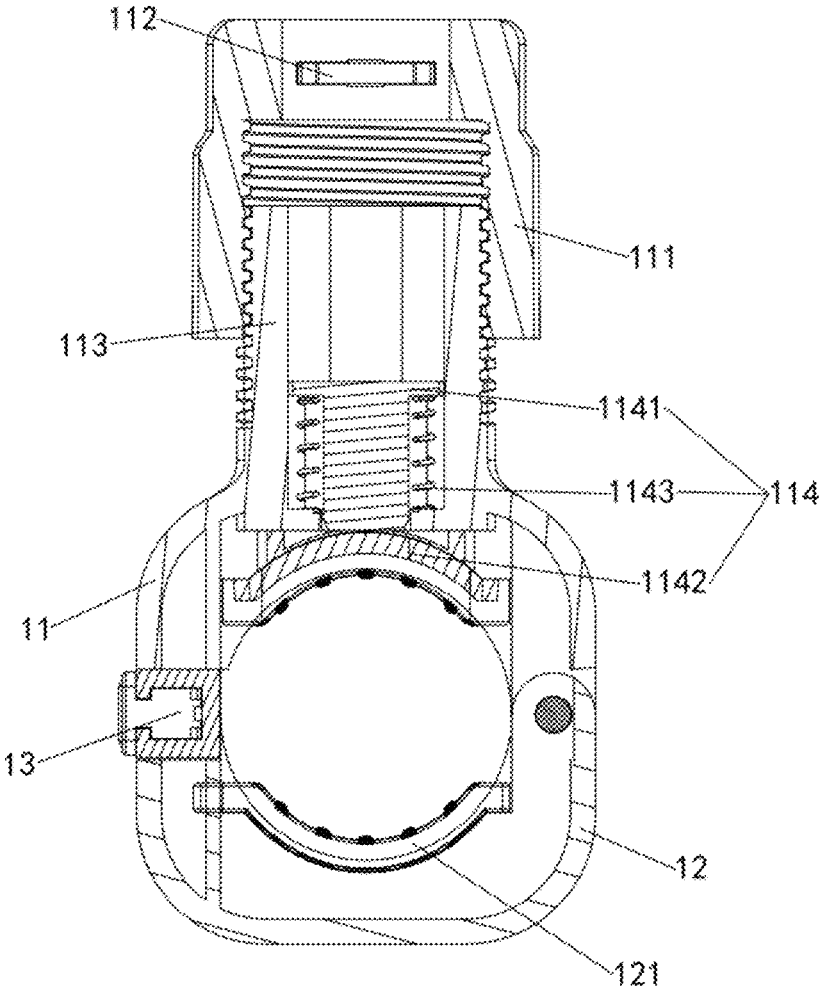
FIG. 4 is a cross-sectional view taken along a cutting line A-A in FIG. 3.

Referring to FIGS. 3 and 4, FIG. 3 is a main view of a connector according to the present utility model, and FIG. 4 is a cross-sectional view taken along a cutting line A-A in FIG. 3. The fixed block 117 is provided with a strip-shaped through groove extending along a length direction of the fixed block 117, the locking device 13 comprises a mounting frame 131 connected in the strip-shaped through groove and a first toggle assembly 132 and a second toggle assembly 133 which are arranged in the mounting frame 131, the first toggle assembly 132 and the second toggle assembly 133 are symmetrically arranged and can move oppositely along the mounting frame 131, when the first toggle assembly 132 and the second toggle assembly 133 are moved to pass through the first main body 11 and partially pass through the second main body 12, the first main body 11 and the second main body 12 are locked, the strip-shaped through groove is used to mount the mounting frame 131, the mounting frame 131 is used to mount the first toggle assembly 132 and the second toggle assembly 133, the first toggle assembly 132 and the second toggle assembly 133 move oppositely, when both the first toggle assembly 132 and the second toggle assembly 133 pass through the first main body 11 and are partially connected into the second main body 12, the first toggle assembly 132 and the second toggle assembly 133 fix the closed first main body 11 and the closed second main body 12, thereby preventing the first main body 11 and the second main body 12 from being separated.

Figure 5:
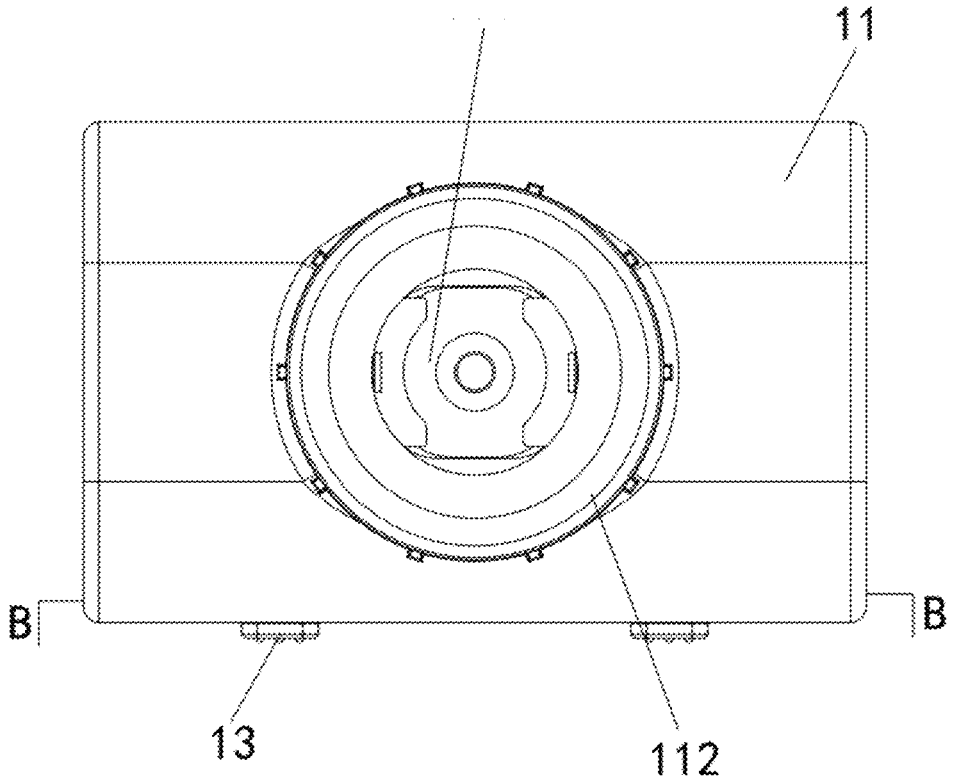
FIG. 5 is a top view of a connector according to the present utility model.
Figure 6:
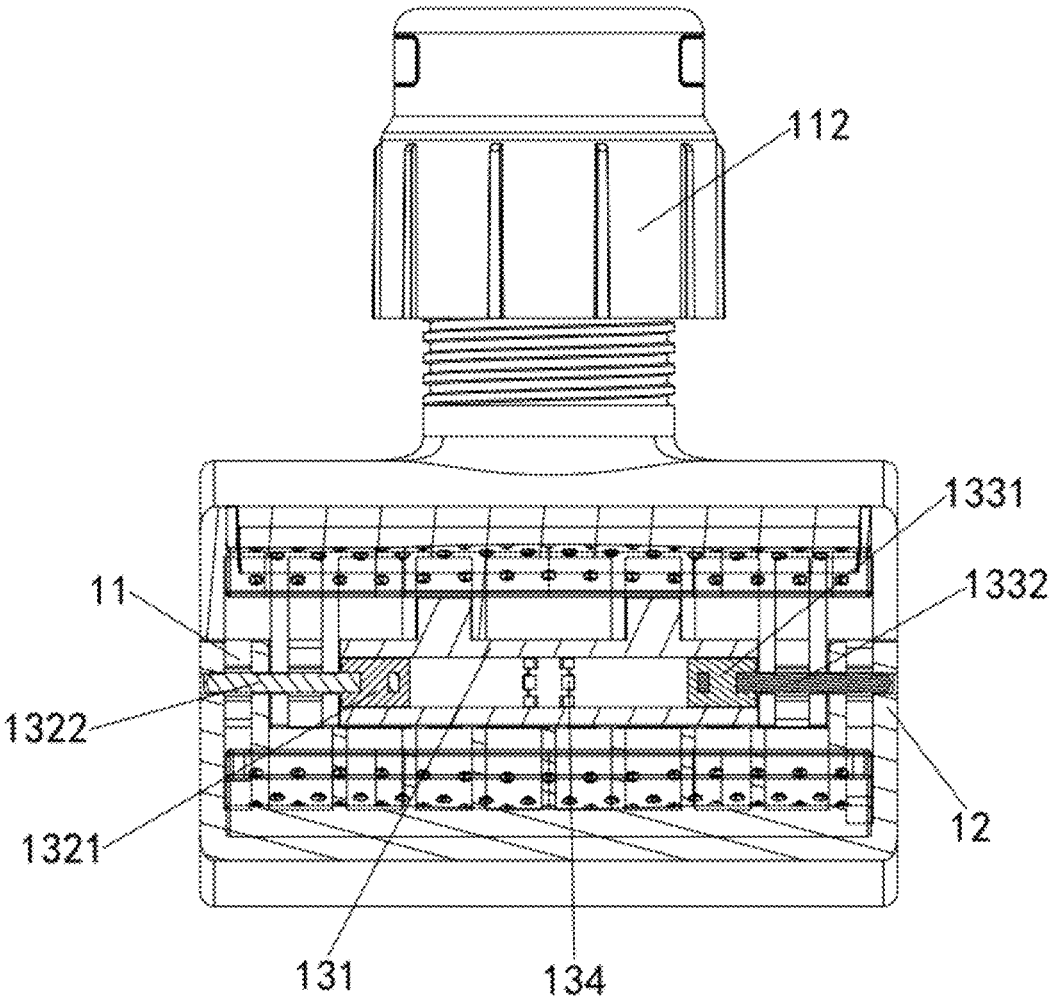
FIG. 6 is a cross-sectional view taken along a cutting line B-B in FIG. 5.

Referring to FIGS. 5 and 6, FIG. 5 is a top view of a connector according to the present utility model, and FIG. 6 is a cross-sectional view taken along a cutting line B-B in FIG. 5. The first toggle assembly 132 comprises a first toggle block 1321 and a first positioning rod 1322 connected to a side of the first toggle block 1321, the second toggle assembly 133 comprises a second toggle block 1331 and a second positioning rod 1332 connected to a side of the second toggle block 1331, a limiting block 134 is provided in the mounting frame 131, the limiting block 134 is positioned between the first toggle assembly 132 and the second toggle assembly 133, the first toggle block 1321 is used to drive the first positioning rod 1322 to move, the first positioning rod 1322 is used to pass through the first main body 11 and connect to the second main body 12, the second toggle block 1331 is used to drive the second positioning rod 1332 to move, and the second positioning rod 1332 is used to pass through the first main body 11 and connect to the second main body 12. Meanwhile, the limiting block 134 is positioned between the first toggle assembly 132 and the second toggle assembly 133, the limiting block 134 is used to prevent the second toggle assembly 133 from entering a movable range of the first toggle assembly 132 or prevent the first toggle assembly 132 from entering a movable range of the second toggle assembly 133.

The first main body 11 is further provided with a nut 111 that is connected to the connection pipe 113 in a threaded manner and is used to fix sporting equipment, the nut 111 is in a hollow arrangement, two sides of the nut 111 are provided with bolts 112 used to clamp the sporting equipment, and the bolts 112 are used to lock the sporting equipment to prevent the sporting equipment from being separated from the connection pipe 113; meanwhile, the nut 111 is used to fasten the sporting equipment to the connection pipe 113 to prevent the sporting equipment from being separated from the connector.

A fastener 114 used to fasten the fitness equipment is further provided in the first main body 11, the nut 111 rotates to drive the sporting equipment to compress the fastener 114, the fastener 114 comprises a reset post 1141 positioned in the connection pipe 113, a fastening piece 1142 positioned in the first through groove and an end of which extends into the reset post 1141, a reset spring 1143 positioned between the reset post 1141 and the fastening piece 1142 and used to reset the reset post 1141, the fastener 114 is used to fasten the fitness equipment to prevent the fitness equipment from shaking in the fixed cavity 14, when the fitness equipment is fastened, the nut 111 rotates to drive the sporting equipment to be compressed towards the reset post 1141, and the reset post 1141 moves towards the fastening piece 1142 after being subjected to the compression force. Meanwhile, the reset spring 1143 deforms under the compression force of the reset post 1141, when the reset post 1141 pushes the fastening piece 1142 to move towards the fitness equipment, the fastening piece 1142 moves towards the fitness equipment and compresses the sporting equipment, the fastener 114 is used to securely connect the fitness equipment within the fixed cavity 14, thereby preventing the fitness equipment from shaking between the first main body 11 and the second main body 12.

In this embodiment, the second through groove is further provided with a bottom pad 121 opposite to the fastening piece 1142, and the bottom pad 121 and the fastening piece 1142 are mutually engaged to further prevent the fitness equipment from shaking between the first main body 11 and the second main body 12.

Rationale:

When the fitness equipment needs to be clamped, firstly, the first toggle assembly 132 and the second toggle assembly 133 are close to each other, so that the first positioning rod 1322 of the first toggle assembly 132 and the second positioning rod 1332 of the second toggle assembly 133 are far away from the second main body 12, thereby preventing the first main body 11 and the second main body 12 from being unopened. Further, after the first main body 11 and the second main body 12 are opened, a position of the fitness equipment to be clamped is placed in the first through groove, the second main body 12 is rotated towards the first main body 11, and the second main body 12 is rotated with the rotation end of the first main body 11 as a rotation center. Further, after the second main body 12 is attached to the closed end of the first main body 11, the first toggle block 1321 and the second toggle block 1331 are toggled, the first toggle block 1321 and the second toggle block 1331 move towards two ends of the mounting frame 131, the first toggle block 1321 pushes the first positioning rod 1322 to pass through the first main body 11 and extend into the second main body 12, the second toggle block 1331 drives the second positioning rod 1332 to pass through the first main body 11 and extend into the second main body 12, so as to fix the first main body 11 and the second main body 12, so that the fitness equipment is fixed in the fixed cavity 14.

Further, when the sporting equipment needs to be mounted, firstly, the sporting equipment is extended into the connection pipe 113, the bolt 112 is extended from two sides of the nut 111 and clamped in the sporting equipment, the nut 111 is rotated, the nut 111 drives the sporting equipment to move towards the fitness equipment, the nut 111 drives the sporting equipment to compress towards the reset post 1141 when descending, and the reset post 1141 presses the reset spring 1143 and pushes the fastening piece 1142 to move towards the fitness equipment; when the two ends of the fitness equipment are respectively attached to the fastening piece 1142 and the bottom pad 121, the fitness equipment is stably fixed in the connector to prevent the fitness equipment from shaking in the connector, and when the fitness equipment needs to be disassembled, the fitness equipment can be disassembled only by withdrawing the first positioning rod 1322 and the second positioning rod 1332 from the second main body 12, and the mounting and disassembly of the fitness equipment does not require the disassembly of the sporting equipment, which makes mounting and disassembly of the fitness equipment more convenient.

First Embodiment

Figure 7:
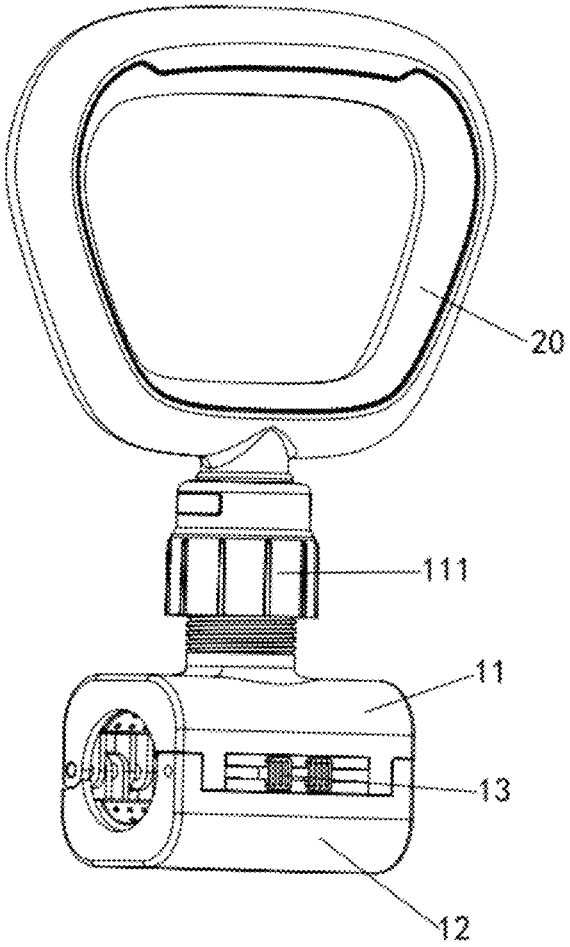
FIG. 7 is a perspective view of a first embodiment of a connector according to the present utility model.
Figure 8:
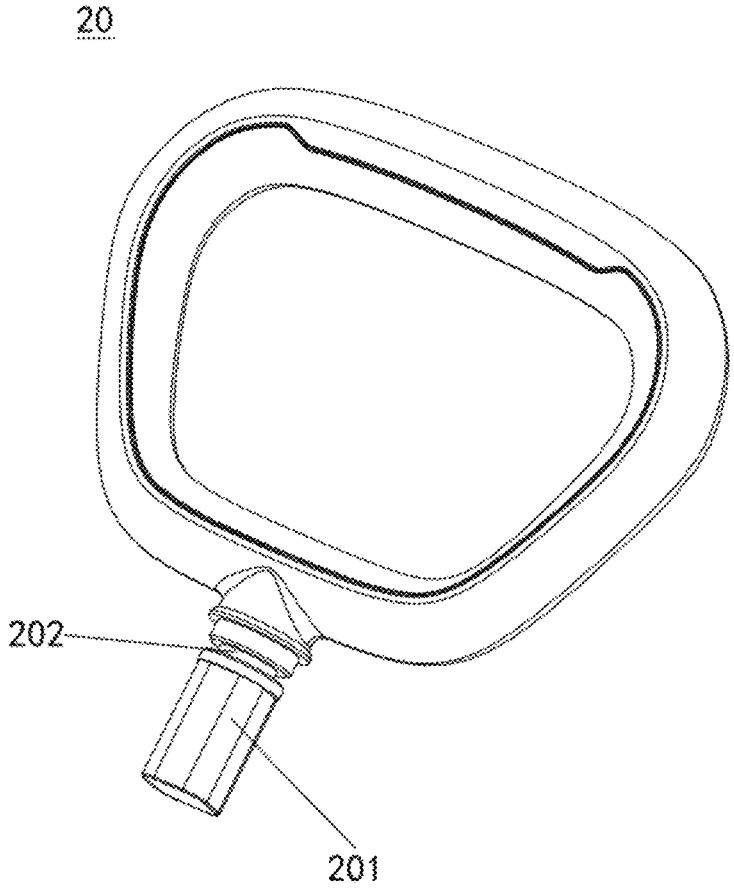
FIG. 8 is a perspective view of a kettlebell handle of a first embodiment of a connector according to the present utility model.

Referring to FIGS. 7 and 8, FIG. 7 is a perspective view of a first embodiment of a connector according to the present utility model, and FIG. 8 is a perspective view of a kettlebell handle of a first embodiment of a connector according to the present utility model. In this embodiment, the kettlebell handle 20 is connected in the connection pipe of the connector and can be used as a kettlebell.

The sporting equipment is a kettlebell handle 20, a lower part of the kettlebell handle is provided with a connection post 201 extending into the connection pipe 113, a peripheral side of the connection post 201 is provided with an annular groove 202 clamped with the bolt 112, the connection post 201 of the kettlebell handle extends into the connection pipe 113, the bolt 112 is clamped in the annular groove 202 of the connection post 201, and the kettlebell handle is fixed on the connector. Further, the nut 111 is rotated, the bolt 112 is driven by the nut 111 to move in the annular groove 202, the nut 111 descends and simultaneously drives the kettlebell handle to compress towards the reset post 1141, the reset post 1141 compresses the reset spring 1143 and pushes the fastening piece 1142 to move towards the sporting equipment, when two ends of the sporting equipment are respectively attached to the fastening piece 1142 and the bottom pad 121, the sporting equipment is stably fixed in the connector, the sporting equipment is prevented from shaking in the connector, and during exercise, the kettlebell handle 20 can be used as a kettlebell by holding the kettlebell handle with hands.

Second Embodiment

Figure 9:
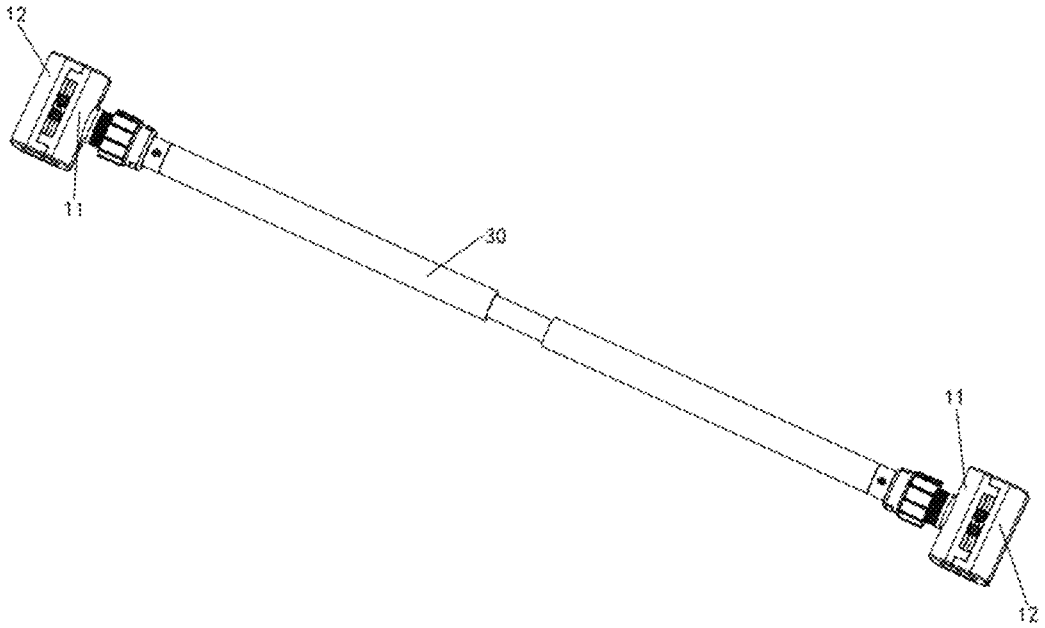
FIG. 9 is a perspective view 1 of a second embodiment of a connector according to the present utility model.
Figure 10:
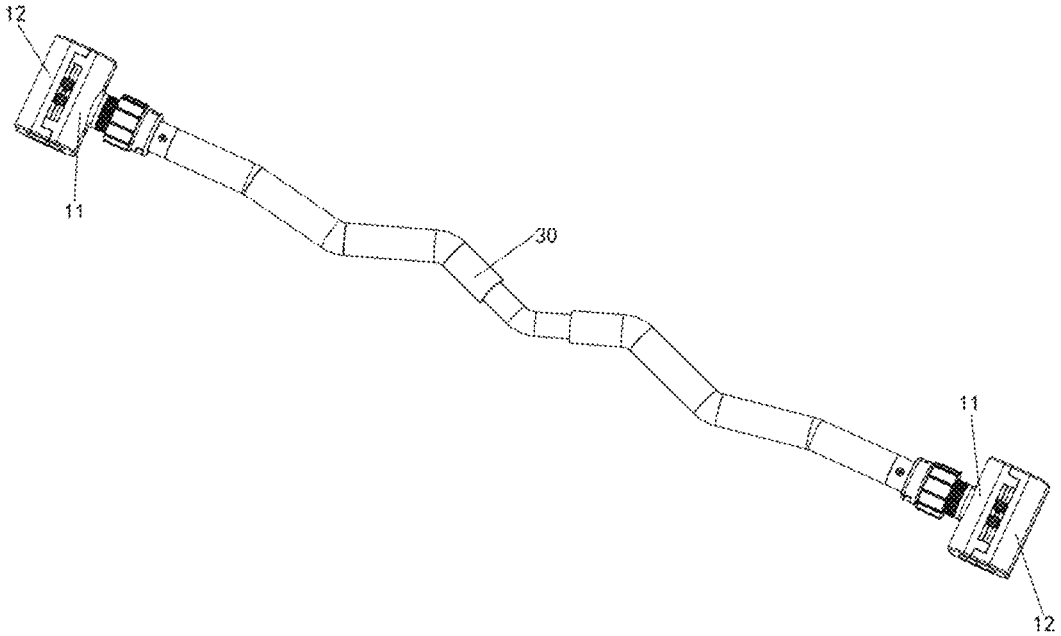
FIG. 10 is a perspective view 2 of a second embodiment of a connector according to the present utility model.

Referring to FIGS. 9 and 10, FIG. 9 is a perspective view 1 of a second embodiment of a connector according to the present utility model, and FIG. 10 is a perspective view 2 of a second embodiment of a connector according to the present utility model. In this embodiment, two ends of a barbell rod 30 are connected in the symmetrical connectors, and the shell is used as a barbell.

The sporting equipment is a barbell rod 30, the connectors are symmetrically arranged, two ends of the barbell rod 30 are provided with connection posts 201 extending into the connection pipe 113, an annular groove 202 clamped with the bolt 112 is arranged on a peripheral side of the connection post 201, two ends of the barbell rod 30 are respectively connected to symmetrical connectors, the connection posts 201 at two ends of the barbell rod 30 are respectively extended into the connection pipes 113 in the symmetrical connectors, and the bolt 112 is clamped in the annular groove 202, so that the symmetrical connectors are transformed into a barbell, which facilitates fitness enthusiasts to exercise in many aspects.

In this embodiment, the barbell rod 30 may also have a wave shape, and the wave-shaped barbell rod 30 facilitates users to grasp the barbell rod 30.

Third Embodiment

Figure 11:
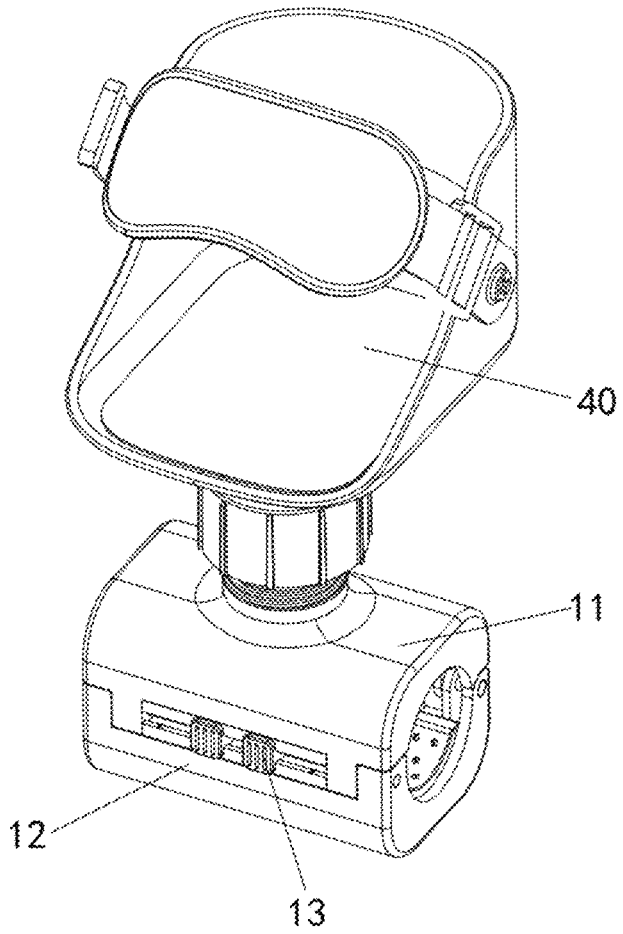
FIG. 11 is a perspective view of a third embodiment of a connector according to the present utility model.

Referring to FIG. 11, FIG. 11 is a perspective view of a third embodiment of a connector according to the present utility model. In this embodiment, a bottom of a shoe cover 40 is connected in the connector, which can be used as leg exercise equipment.

The sporting equipment is a shoe cover 40, a bottom of the shoe cover 40 is provided with a connection post 201 extending into a connection pipe 113, an annular groove 202 clamped with a bolt 112 is arranged on a peripheral side of the connection post 201, the connection post 201 at the bottom of the shoe cover 40 extends into the connection pipe 113, the bolt 112 is clamped in the annular groove 202, the fitness enthusiasts can extend feet into the shoe cover 40 to exercise legs, and the legs can be exercised by wearing the feet on the shoe cover 40.

Fourth Embodiment

Figure 12:
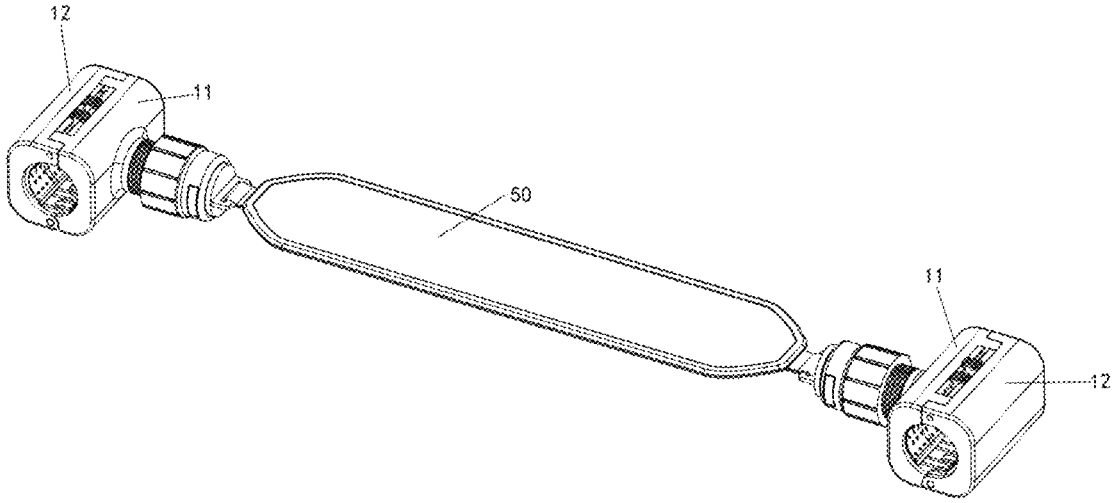
FIG. 12 is a perspective view of a fourth embodiment of a connector according to the present utility model.

Referring to FIG. 12, FIG. 12 is a perspective view of a fourth embodiment of a connector according to the present utility model. In this embodiment, two ends of a band 50 are connected in the connector, which can be used as waist exercise equipment.

The sporting equipment is a band 50, the connectors are symmetrically arranged, two ends of the band 50 are provided with connection posts 201 extending into the connectors, an annular groove 202 clamped with the bolt 112 is arranged on a peripheral side of the connection post 201, the connection posts 201 at two ends of the band 50 are respectively connected in the connection pipes 113 of the connectors and then are clamped in the annular groove 202 by the bolt 112, and the band 50 is placed on the waist of the fitness enthusiast, so that the fitness enthusiast can exercise the waist. When the waist needs to be exercised, the fitness enthusiast lies down on the ground, places the band 50 on the waist, and places the connectors at two ends on two sides of the fitness enthusiast respectively, which facilitates the fitness enthusiast to exercise the waist conveniently.

The connector of this preferred embodiment clamps the fitness equipment and places the fitness equipment in the first through groove, the second main body rotates with the rotation end of the first main body as a rotation center and is closed with the closed end of the first main body, the closed first main body and the closed second main body are locked by the locking device, and when the fitness equipment is disassembled, only the first main body and the second main body need to be unlocked by the locking device without disassembling the sporting equipment connected to the connection pipe, which makes mounting and disassembly of the fitness equipment more convenient.

In conclusion, although the present utility model has been disclosed above with preferred embodiments, the foregoing preferred embodiments are not intended to limit the present utility model, and those of ordinary skill in the art can make various changes and modifications without departing from the spirit and scope of the present utility model. Therefore, the protection scope of the present utility model shall be subject to the scope defined by the claims.

What is claimed is:

1. A connector, comprising:

a first main body with a rotation end and a closed end, and a second main body that is rotatably connected to the rotation end of the first main body and can be closed with the closed end of the first main body, wherein a first through groove is provided at an inner side of the first main body, a second through groove is provided at a position of the second main body opposite to the first through groove, the first through groove and the second through groove enclose to form a fixed cavity configured to fix a fitness equipment, the first main body is further provided with a connection pipe configured to be connected to a sporting equipment, the connection pipe communicating with the first through groove, a vertical plane where the connection pipe is positioned is not coplanar with a vertical plane where the rotation end is positioned and a vertical plane where the closed end is positioned, and the connector further comprises a locking device configured to open or close the fixed cavity;

wherein the closed end of the first main body is further provided with a fixed block protruding towards the second main body, a fixed groove is provided at a position of the second main body opposite to the fixed block, and the locking device is connected to the fixed block;

wherein the fixed block is provided with a strip-shaped through groove extending along a length direction of the fixed block, the locking device comprises a mounting frame connected in the strip-shaped through groove and a first toggle assembly and a second toggle assembly which are arranged in the mounting frame, the first toggle assembly and the second toggle assembly are symmetrically arranged and can move oppositely along the mounting frame, and when the first toggle assembly and the second toggle assembly are moved to penetrate through the first main body and partially penetrate through the second main body, the first main body and the second main body are locked.

2. The connector according to claim 1, wherein the first toggle assembly comprises a first toggle block and a first positioning rod connected to a side of the first toggle block, and the second toggle assembly comprises a second toggle block and a second positioning rod connected to a side of the second toggle block.

3. The connector according to claim 1, wherein a limiting block is further provided in the mounting frame, and the limiting block is positioned between the first toggle assembly and the second toggle assembly.

4. The connector according to claim 1, wherein the first main body is further provided with a nut that is connected to the connection pipe in a threaded manner and is configured to fix the sporting equipment to the connection pipe and a bolt that is connected to the nut and is configured to clamp the sporting equipment, and the nut is hollow.

5. The connector according to claim 4, wherein the sporting equipment is a kettlebell handle, a lower part of the kettlebell handle is provided with a connection post extending into the connection pipe, and a peripheral side of the connection post is provided with an annular groove clamped with the bolt.

6. The connector according to claim 4, wherein the sporting equipment is a barbell rod, each end of the barbell rod is provided with a connection post extending into the connection pipe, a peripheral side of the connection post is provided with an annular groove clamped with the bolt.

7. The connector according to claim 4, wherein the sporting equipment is a shoe cover, a bottom of the shoe cover is provided with a connection post extending into the connection pipe, and a peripheral side of the connection post is provided with an annular groove clamped with the bolt.

8. The connector according to claim 4, wherein the sporting equipment is a band, the connectors are symmetrically arranged, connection posts extending into the connectors are arranged at two ends of the band, and peripheral sides of the connection posts are provided with annular grooves clamped with the bolts.

9. A connector, comprising:

a first main body with a rotation end and a closed end, and a second main body that is rotatably connected to the rotation end of the first main body and can be closed with the closed end of the first main body, wherein a first through groove is provided at an inner side of the first main body, a second through groove is provided at a position of the second main body opposite to the first through groove, the first through groove and the second through groove enclose to form a fixed cavity configured to fix a fitness equipment, the first main body is further provided with a connection pipe configured to be connected to a sporting equipment, the connection pipe communicating with the first through groove, a vertical plane where the connection pipe is positioned is not coplanar with a vertical plane where the rotation end is positioned and a vertical plane where the closed end is positioned, and the connector further comprises a locking device configured to open or close the fixed cavity;

wherein the first main body is further provided with a nut that is connected to the connection pipe in a threaded manner and is configured to fix a sporting equipment to the connection pipe and a bolt that is connected to the nut and is configured to clamp the sporting equipment, and the nut is hollow;

wherein a fastener configured to fasten the fitness equipment is further provided in the first main body, and the fastener is compressed when the nut rotates.

10. The connector according to claim 9, wherein the fastener comprises a reset post positioned in the connection pipe, a fastening piece positioned in the first through groove and an end of which extends into the reset post, and a reset spring positioned between the reset post and the fastening piece and configured to reset the reset post, when the fitness equipment is to be fastened, the nut rotates to drive the sporting equipment to compress towards the reset post, and the reset post moves towards the fastening piece after being subjected to a compression force, the reset spring deforms under the compression force, when the reset post pushes the fastening piece to move towards the fitness equipment, the fastening piece moves towards the fitness equipment and compresses the fitness equipment.

* * * * *